US009230483B2

(12) United States Patent
Tseng et al.

(10) Patent No.: US 9,230,483 B2
(45) **Date of Patent: *Jan. 5, 2016**

(54) PIXEL CIRCUIT AND DRIVING METHOD AND DISPLAY DEVICE THEREOF

(71) Applicant: InnoLux Corporation, Miao-Li County (TW)

(72) Inventors: Ming Chun Tseng, Miao-Li County (TW); Yi Hua Hsu, Miao-Li County (TW); Kung-Chen Kuo, Miao-Li County (TW); Lien-Hsiang Chen, Miao-Li County (TW)

(73) Assignee: INNOLUX CORPORATION (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/260,341

(22) Filed: Apr. 24, 2014

(65) Prior Publication Data

US 2014/0292736 A1 Oct. 2, 2014

Related U.S. Application Data

(63) Continuation-in-part of application No. 14/044,993, filed on Oct. 3, 2013.

(30) Foreign Application Priority Data

Mar. 28, 2013 (TW) ..... 102111099 A

(51) Int. Cl.
*G09G 3/32* (2006.01)

(52) U.S. Cl.
CPC ..... *G09G 3/3291* (2013.01); *G09G 3/3241* (2013.01); *G09G 2300/0814* (2013.01); *G09G 2300/0819* (2013.01); *G09G 2300/0861* (2013.01); *G09G 2310/0243* (2013.01); *G09G 2310/0251* (2013.01)

(58) Field of Classification Search
CPC ..... G09G 3/3233; G09G 2300/0852; G09G 2300/0814; G09G 2300/0819; G09G 2300/0861; G09G 3/3258; G09G 3/3208; G09G 3/3291; G09G 3/3241; G09G 2310/0243; G09G 2310/0251
See application file for complete search history.

(56) References Cited

U.S. PATENT DOCUMENTS

2005/0052377 A1* 3/2005 Hsueh ..... G09G 3/3233 345/82
2005/0156829 A1* 7/2005 Choi ..... G09G 3/3233 345/76
2005/0285825 A1* 12/2005 Eom ..... G09G 3/3233 345/76

(Continued)

*Primary Examiner* — Lun-Yi Lao
*Assistant Examiner* — Elliott Deaderick
(74) *Attorney, Agent, or Firm* — Bacon & Thomas, PLLC

(57) ABSTRACT

A pixel circuit includes an OLED, a driving transistor, first and second transistors, a storage capacitor and a coupling capacitor. The OLED includes an anode and a cathode connected to a first voltage source. The driving transistor includes a first node connected to a second voltage source, a second node, and a third node connected to the anode. The first transistor includes first, second and third terminals connected to a data driving line, a first control signal source, and the second node, respectively. The second transistor includes a first terminal, a second terminal connected to a second control signal source, and a third terminal connected to the anode and the third node. The storage capacitor includes first and second terminals connected to a third voltage source and the second transistor, respectively. The coupling capacitor includes first and second terminals connected to the second transistor and the second node, respectively.

8 Claims, 15 Drawing Sheets

(56) References Cited

U.S. PATENT DOCUMENTS

2006/0028408 A1* 2/2006 Kim ..... 345/76
2006/0176250 A1* 8/2006 Nathan et al. ..... 345/76
2007/0120795 A1* 5/2007 Uchino et al. ..... 345/92
2008/0001861 A1* 1/2008 Asano et al. ..... 345/77
2008/0043005 A1* 2/2008 Kanda ..... G09G 3/3233 345/204
2009/0219232 A1* 9/2009 Choi ..... G09G 3/3233 345/76

* cited by examiner

PIXEL CIRCUIT AND DRIVING METHOD AND DISPLAY DEVICE THEREOF

BACKGROUND OF THE INVENTION

1. Field of the Invention

The present invention relates to a pixel circuit and its driving method and, more particularly, to an active matrix OLED pixel circuit and its driving method suitable for compensating transistor threshold voltage and OLED voltage.

2. Description of Related Art

Driving transistors of active matrix OLED (AMOLED) can be classified to P-type transistors and N-type transistors according to its back plate manufacture technologies. Please refer to FIG. 1 and FIG. 2, which are prior P-type and N-type driving circuits of AMOLED, respectively. As shown in FIG. 2, for the N-type driving circuit, there is a problem in that the threshold voltage of the N-type transistor may be shifted. This threshold voltage shift is caused by the generation of degradation due to the manufacture variation and long-time operation, resulting in being unable to output a current same as the initial current and thus producing mura or brightness decay. Moreover, due to that the OLED is operated for a long time, the operating voltage is increased following the increase of the time. Thus, to solve the aforementioned problem, an N-type compensation circuit is proposed. With reference to both FIG. 3 and FIG. 4, there are a schematic diagram of N-type AMOLED compensation driving circuit and a timing diagram of N-type compensation driving circuit. As shown in FIG. 3 and FIG. 4, it can be seen that the number of components (6T2C) in the pixel circuit design is too many and the driving signals (Sn, Sn', En, Xen) become too complicated, resulting in being unable to satisfy the requirements of high precision and high aspect ratio.

Therefore, it is desirable to provide an improved pixel circuit and its driving method, in which N-type driving transistors are used to drive the OLED, and combined with a plurality of transistors and capacitors to compensate the threshold voltage of the N-type transistor and the voltage of the AMOLED, so as to satisfy the requirements of high precision and high aspect ratio.

SUMMARY OF THE INVENTION

The invention provides a pixel circuit, which comprises: an OLED including an anode, and a cathode connected to a first voltage source; a driving transistor for driving the OLED including a first node connected to a second voltage source, a second node, and a third node connected to the anode; a first transistor including a first terminal connected to a data driving line, a second terminal connected to a first control signal source, and a third terminal connected to the second node; a second transistor including a first terminal, a second terminal connected to a second control signal source, and a third terminal connected to the anode and the third node; a storage capacitor including a first terminal connected to a third voltage source and a second terminal connected to the first terminal of the second transistor; a reset transistor including a first terminal connected to the anode and the third node, a second terminal connected to a reset control signal source, and a third terminal connected to a reference voltage source or the data driving line; and a coupling capacitor including a first terminal connected to the first terminal of the second transistor and a second terminal connected to the second node.

Moreover, the driving transistor, first transistor, second transistor and reset transistor are N-type transistors.

Moreover, in a reset stage, the first control signal source provides a first control signal to turn the first transistor on, the second control signal source provides a second control signal to turn the second transistor on, the reset control signal source provides a reset control signal to turn the reset transistor on, the data driving line inputs a first reference voltage to the driving transistor to reset the second node, and the reference voltage source provides a second reference voltage or the data driving line provides the first reference voltage to the reset transistor to reset the third node and the first terminal of the coupling capacitor; in a compensating stage, the data driving line inputs a third reference voltage to the second node, the third node and the storage capacitor store a difference between the third reference voltage and the threshold voltage of the driving transistor, and the driving transistor is transited from on state to off state; in a programming stage, the data driving line inputs a data voltage to the driving transistor, and a difference between the third reference voltage and the data voltage is coupled to the first terminal of the coupling capacitor; in a light emitting stage, the threshold voltage and a voltage of the OLED are coupled to the second node.

Furthermore, the invention provides a method for driving a pixel circuit, wherein the pixel circuit comprises an OLED including an anode and a cathode connected to a first voltage source; a driving transistor for driving the OLED, the driving transistor including a first node connected to a second voltage source, a second node and a third node connected to the anode; a first transistor including a first terminal connected to a data driving line, a second terminal connected to a first control signal source and a third terminal connected to the second node; a second transistor including a first terminal, a second terminal connected to a second control signal source and a third terminal connected to the anode and the third node; a storage capacitor including a first terminal connected to a third voltage source and a second terminal connected to the first terminal of the second transistor; a coupling capacitor including a first terminal connected to the first terminal of the second transistor and a second terminal connected to the second node; and a reset transistor including a first terminal connected to the anode and the third node, a second terminal connected to a reset control signal source and a third terminal connected to a reference voltage source or the data driving line. The method comprises the steps of: (A) in a reset stage, the data driving line inputting a first reference voltage to the driving transistor to reset the second node, and the reference voltage source providing a second reference voltage or the data driving line providing the first reference voltage to the reset transistor to reset the third node and the first terminal of the coupling capacitor; (B) in a compensating stage, the data driving line inputting a third reference voltage to the second node, the third node and the storage capacitor storing a difference between the third reference voltage and the threshold voltage of the driving transistor, and the driving transistor being transited from on state to off state; (C) in a programming stage, the data driving line inputting a data voltage to the driving transistor, and a difference between the third reference voltage and the data voltage being coupled to the first terminal of the coupling capacitor; and (D) in a light emitting stage, the threshold voltage and a voltage of the OLED being coupled to the second node.

In addition, the invention provides a display panel, which comprises: a plurality of pixel circuits arranged as a pixel circuit matrix according a plurality of columns and rows; a data driver having a plurality of data driving lines connected to the pixel circuits on the columns of the pixel circuit matrix for providing at least an input voltage; a scan driver having a plurality of scan driving lines vertically intersected with the data driving lines for being connected to the pixel circuits on the rows of the pixel circuit matrix for providing at least a switching voltage; and a timing controller connected to the data driver and the scan driver for controlling the data driver and the scan driver.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
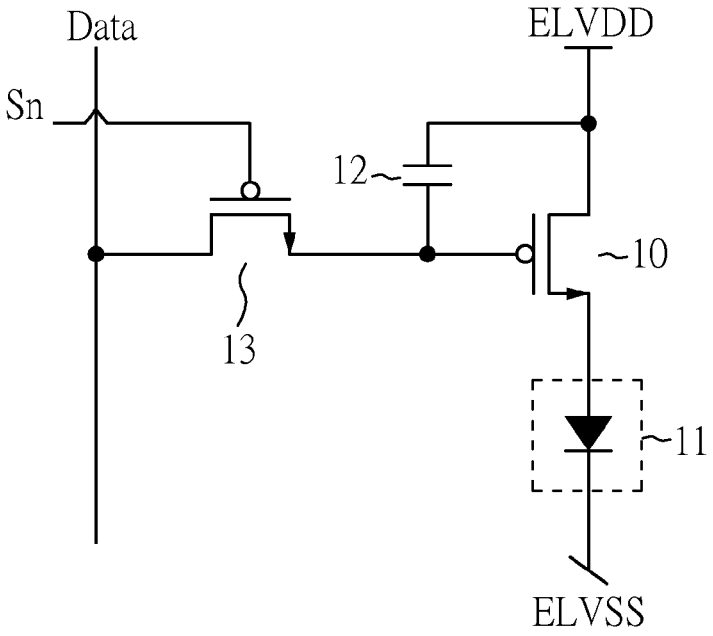
FIG. 1 (PRIOR ART)
FIG. 1 is a schematic diagram of a prior P-type driving circuit of an AMOLED.
Figure 2:
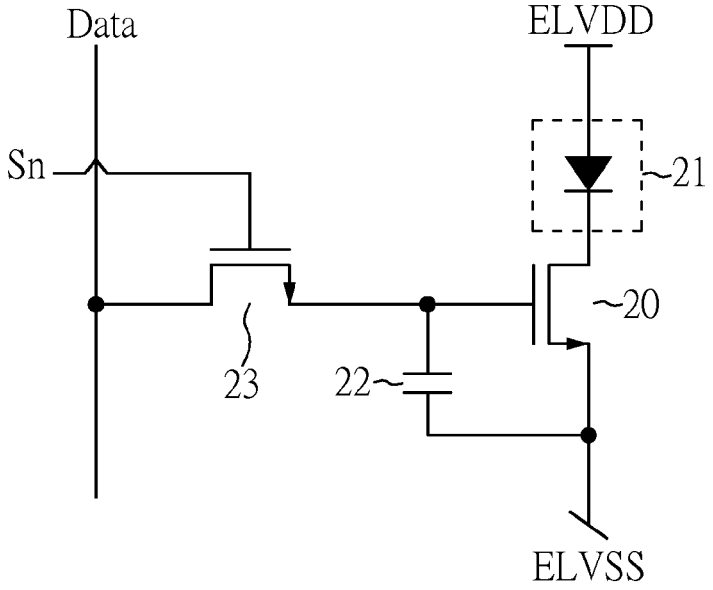
FIG. 2 (PRIOR ART)
FIG. 2 is a schematic diagram of a prior N-type driving circuit of an AMOLED.
Figure 3:
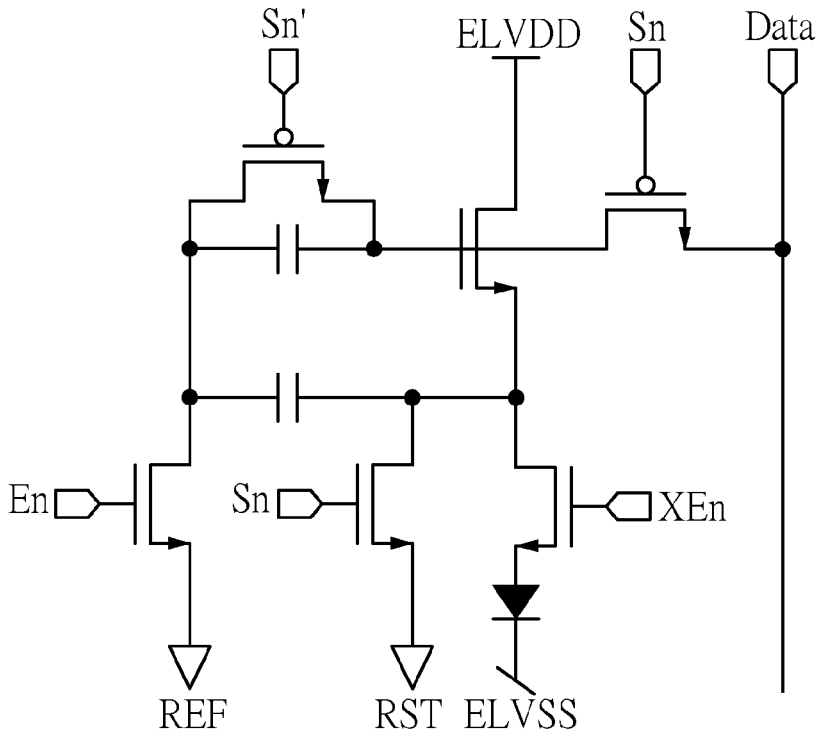
FIG. 3(PRIOR ART)
FIG. 3 is a schematic diagram of a prior N-type compensation driving circuit of an AMOLED.
Figure 4:
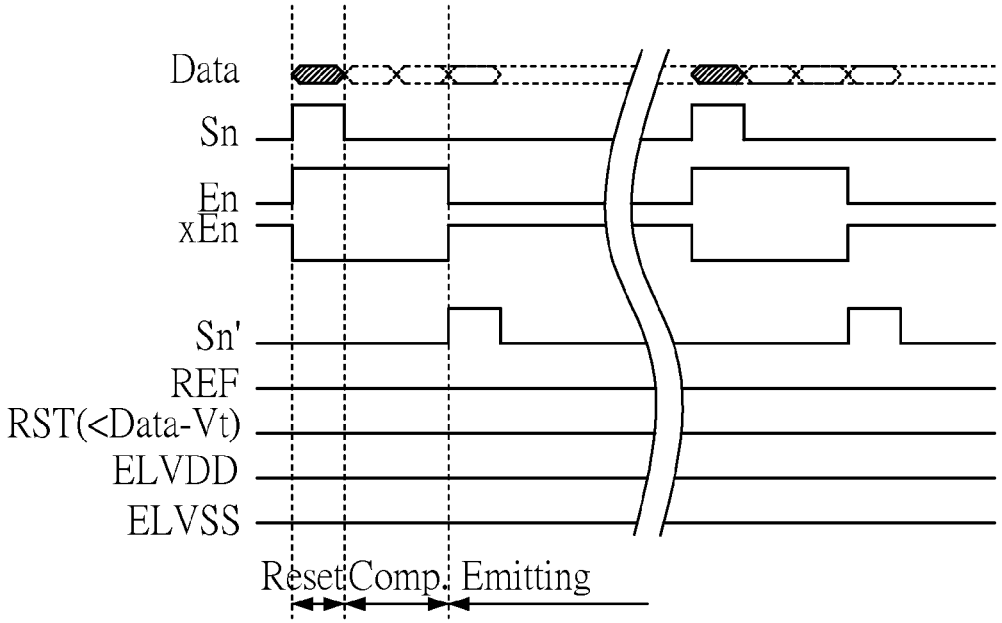
FIG. 4 (PRIOR ART)
FIG. 4 is a timing diagram of the compensation driving circuit shown in FIG. 3.
Figure 5:
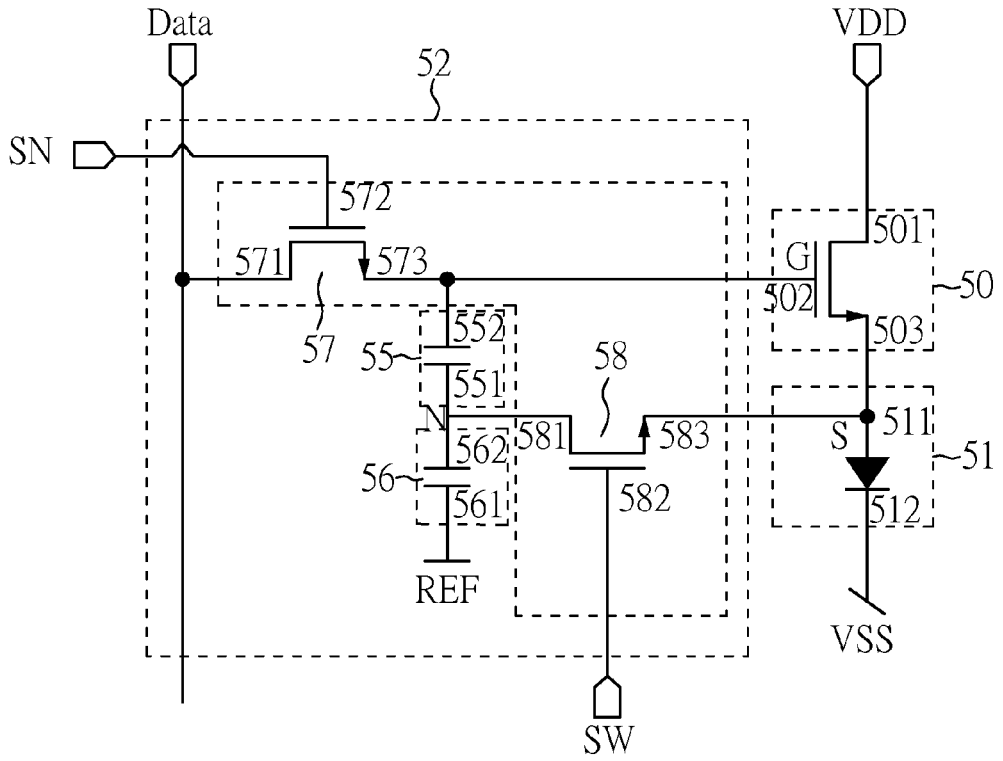
FIG. 5 is a schematic diagram of the pixel circuit in accordance with a preferred embodiment of the invention.

With reference to FIG. 5, there is shown a schematic diagram of a pixel circuit in accordance with a preferred embodiment of the invention. As shown, the pixel circuit includes: a driving transistor 50, an OLED 51, and a voltage control unit 52. The OLED 51 includes an anode 511 and a cathode 512, wherein the cathode 512 is connected to a first voltage source VSS that provides a first voltage Vss. The driving transistor 50 is preferred to be an N-type transistor including a first node 501, a second node 502 and a third node 503, wherein the first node 501 is a drain electrically connected to a second voltage source VDD that provides a second voltage Vdd, the second node 502 is a gate, and the third node 503 is a source electrically connected to the anode 511.

The aforementioned voltage control unit 52 includes a first transistor 57, a second transistor 58, a storage capacitor 56 and a coupling capacitor 55. The first transistor 57 has a first terminal 571 connected to a data driving line (Data), a second terminal 572 connected to a first control signal source SN that provides a first control signal, and a third terminal 573 connected to the second node 502. The second transistor 58 has a first terminal 581, a second terminal 582 connected to a second control signal source SW that provides a second control signal, and a third terminal 583 connected to the anode 511 and the third node 503. The first and second transistors 57, 58 are preferred to be N-type transistors. The storage capacitor 56 has a first terminal 561 connected to a third voltage source REF, and a second terminal 562 connected to the first terminal 581 of the second transistor 58. The coupling capacitor 55 has a first terminal 551 connected to the first terminal 581 of the second transistor 58, and a second terminal 552 connected to the second node 502. Accordingly, when the pixel circuit is in a reset stage, the first transistor 57 is turned on by the first control signal, and a reference voltage Vref is inputted to the driving transistor 50 to reset the second node 502, the third node 503 and the first terminal 581 of the second transistor 58. When the pixel circuit is in a compensation stage, a threshold voltage Vt of the driving transistor 50 is stored into the third node 503 and the storage capacitor 56, and then the driving transistor 50 is transited from on state to off state. When the pixel circuit is in a programming stage, the second transistor 58 is turned off by the second control signal, a data voltage is inputted to the driving transistor 50, and a voltage of the coupling capacitor 55 is coupled to the first terminal 581 of the second transistor 58. When the pixel circuit is in a light emitting stage, the threshold voltage Vt and a voltage Voled of the OLED 51 are coupled to the second node 502. The aforementioned reset stage, compensation stage, programming stage and light emitting stage are executed repeatedly in sequence.

Figure 6:
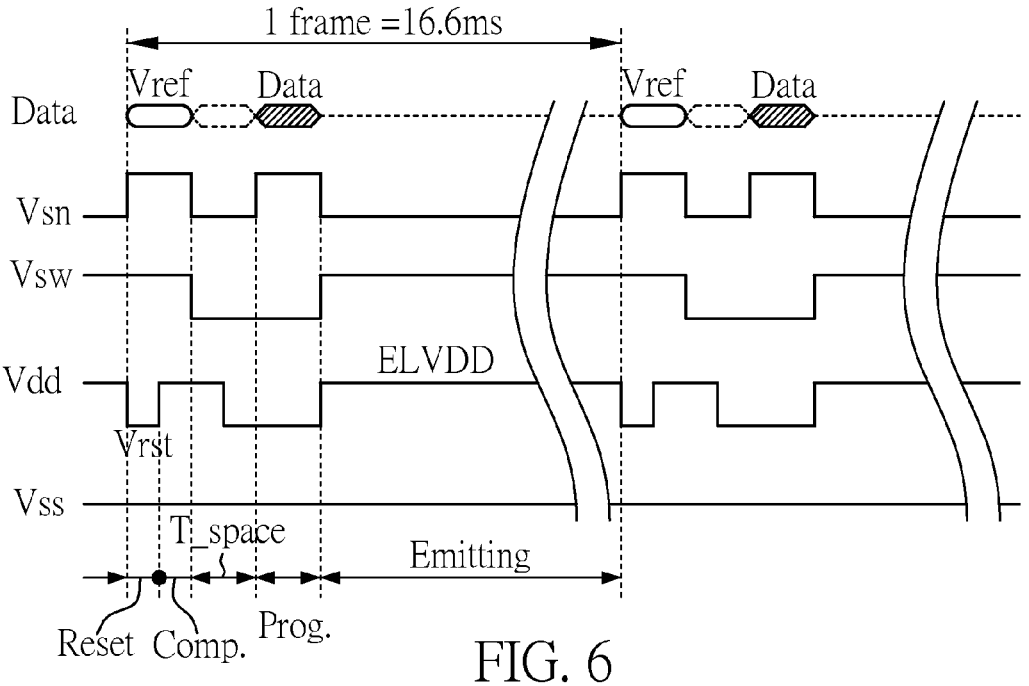
FIG. 6 is a timing diagram of the pixel circuit shown in FIG. 5.

With reference to FIG. 6, which is a timing diagram of the pixel circuit shown in FIG. 5, the circuit operation can be divided into the reset stage (Reset), compensation stage (Comp.), programming stage (Prog.) and light emitting stage (Emitting). The on/off states of the driving transistor 50, the first transistor 57, the second transistor 58 and the OLED 51 corresponding those stages are illustrated in Table 1, and a voltage ($V_G$) of the second node 502 of the driving transistor 50, a voltage (Vs) of the anode 511 of the OLED 51, a voltage ($V_N$) of the first terminal 551 of the coupling capacitor 55, a voltage difference ($V_{GS}$) between the second node 502 and the anode 511, and a voltage difference ($V_{GN}$) between the second node 502 and the first terminal 551 of the coupling capacitor 55 are illustrated in Table 2.

TABLE 1

| Cycle | Driving transistor | First transistor | Second transistor | OLED |
|---|---|---|---|---|
| Reset stage | ON | ON | ON | OFF |
| Comp. stage | OFF | ON | ON | OFF |
| Prog. stage | ON | ON | OFF | OFF |

TABLE 1-continued

| Cycle | Driving transistor | First transistor | Second transistor | OLED |
|---|---|---|---|---|
| Emitting stage | ON | OFF | ON | ON |

TABLE 2

| | Reset stage | Comp. stage | Prog. stage | Emitting stage |
|---|---|---|---|---|
| Second node of the driving transistor ($V_G$) | Vref | Vref | Vdata | (Vdata – Vref) * (1 – f1) + Vt + Voled |
| Anode of the OLED ($V_S$) | Vrst | Vref – Vt | Vrst | Voled |
| First terminal of the coupling capacitor ($V_N$) | Vrst | Vref – Vt | Vref * (1 – f1) + Vdata * f1 – Vt | Voled |
| Voltage difference between the second node and the anode ($V_{GS}$) | Vref – Vrst | Vt | Vdata – Vrst | (Vdata – Vref) * (1 – f1) + Vt |
| Second node and the first terminal of the coupling capacitor ($V_{GN}$) | Vref – Vrst | Vt | (Vdata – Vref) * (1 – f1) + Vt | (Vdata – Vref) * (1 – f1) + Vt |

As a result, in the reset stage, the driving transistor 50, first transistor 57, and second transistor 58 are in on state, and the OLED 51 is in off state. The data driving line (Data) inputs a reference voltage Vref to the first terminal 571 of the first transistor 57, and then to the third terminal 573 of the first transistor 57 so as to reset the second node 502 to be the reference voltage Vref, and the second voltage Vdd is a reset voltage Vrst at the same time, satisfying the relation of Vref>Vrst+Vt, such that the third node 503 is reset to be the reset voltage Vrst, and thus the first terminal 551 of the coupling capacitor 55 is reset to be the reset voltage Vrst.

In the compensation stage, the first transistor 57 and the second transistor 58 are in on state, and the OLED 51 is in off state. The second node 502 is still the reference voltage Vref, and the second voltage Vdd is transited to a high potential voltage ELVDD at the same time, such that the driving transistor 50 is turned gradually from on to off by discharging, and the anode 511 of the OLED 51 is discharged to Vref-Vt, so as to measure the threshold voltage Vt of the driving transistor 50 and then store it into the storage capacitor 56.

As shown in FIG. 6, after the compensation stage, there is a space time (T_space), which is a period of time between the compensation stage and the programming stage, and the space time is greater than or equal to 0.

In the programming stage, the driving transistor 50 and the first transistor 57 are in on state, and the second transistor 58 and the OLED 51 are in off state. The data driving line (Data) inputs a data voltage Vdata to the first terminal 571 of the first transistor 57, and then to the third terminal 573 of the first transistor 57 so as to allow the second node 502 to be the data voltage Vdata, and the second voltage Vdd is the reset voltage Vrst at the same time, such that the voltage $V_N$ of the first terminal 511 of the coupling capacitor 55 is coupled, via the coupling capacitor 55, to:

$$V_N = Vref - Vt + (Vdata - Vref) * f1 = Vref * (1 - f1) + Vdata * f1 - Vt, \quad (1)$$

and the voltage difference between the second node 502 and the first terminal 511 of the coupling capacitor 55 is:

$$V_{GN} = Vdata - (Vref(1 - f1) + Vdata * f1 - Vt) = (Vdata - Vref) * (1 - f1) + Vt, \quad (2)$$

wherein f1=Ccp/(Ccp+Cst), Ccp is capacitance value of the coupling capacitor 55, and Cst is capacitance value of the storage capacitor 56. The storage capacitor 56 has both the threshold voltage Vt and data voltage Vdata in the previous stage, such that the voltage difference $V_{GN}$ between the second node 502 and the first terminal 551 of the coupling capacitor 55 is greater than or equal to the threshold voltage Vt. Meanwhile, the OLED 51 cannot be turned on, and thus the following conditions have to be satisfied:

$$Vrst \leq Vss + \text{Voled}(0), \quad (3)$$

wherein Voled(0) is a turn-on voltage of the OLED 51.

In the light emitting stage, the driving transistor 50, second transistor 58 and OLED 51 are in on state, and the first transistor 57 is in off state. The anode 511 and the first terminal 551 of the coupling capacitor 55 are both the voltage Voled of the OLED 51, and the coupling capacitor 55 couples the voltage Voled of the OLED 51 to the second node 502:

$$V_G = Vdata + (Voled - (Vref * (1 - f1) + Vdata * f1 - Vt)) = (Vdata - Vref) * (1 - f1) + Vt + Voled, \quad (4)$$

while the voltage difference between the second node 502 and the anode 511 is:

$$V_{Gs} = (\text{Vdata} - Vref) * (1 - f1) + Vt, \quad (5)$$

so that the output current $I_{oled}$ of the driving transistor 50 can be expressed as:

$$I_{oled} = Kp * (V_{GS} - Vt)^2 = Kp * [(Vdata - Vref) * (1 - f1)]^2, \quad (6)$$

where Kp=½(μ*COX)(W/L), μ is carrier mobility of the driving transistor 50, COX is a per area capacitance of the driving transistor, and (W/L) is a width to length ratio of the driving transistor 50. From equation (6), it can be known that the output current of the driving transistor 50 is not related with the threshold voltage Vt and the voltage of the OLED 51 ($V_{oled}$), thereby not only compensating the threshold voltage of the transistor and the voltage of the AMOLED, but also satisfying the requirements of high precision and high aspect ratio.

It is noted that, in the light emitting stage, there are charges distributed into the first terminal 551 of the coupling capacitor 55 and the third node 503 due to the second transistor 58 being turned on instantaneously. In the moment of turning on the second transistor 58, the first terminal 551 of the coupling capacitor 55 can be expressed as:

$$V_N=\{V_{N_pro}*Cst+V_{S_pro}*\text{Coled}\}/(Cst+\text{Coled}), \quad (7)$$

where Coled is a capacitance value of the OLED 51, $V_{N_pro}$ is the voltage of the first terminal 551 of the coupling capacitor 55 in the program stage (i.e. Vref*(1−f1)+Vdata*f1−Vt), and $V_{S_pro}$ is the voltage of the third node 503 in the program stage. If the capacitance value can be ignored (i.e. the Coled is much smaller than the capacitance value of the storage capacitor 56 (Cst)), the equation (7) can be simplified as:

$$V_N=Vref*(1-f1)+\text{Vdata}*\text{f1}-Vt. \quad (8)$$

It is thus known that the voltage of the first terminal 551 of the coupling capacitor 55 is maintained to be unchanged, i.e., it still stores the threshold voltage Vt and the voltage of the OLED 51 (Voled). However, if the capacitance value Coled cannot be ignored, the stored threshold voltage Vt of the first terminal 551 of the coupling capacitor 55 may be lost due to the charges distributed between it and the third node 503.

Figure 7:
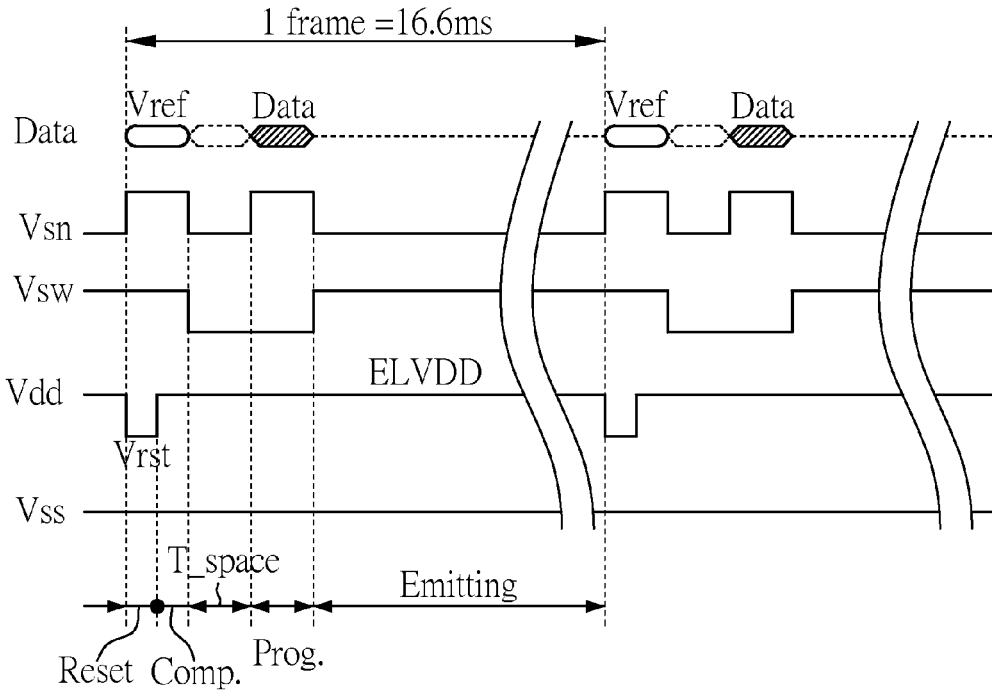
FIG. 7 is another timing diagram of the pixel circuit shown in FIG. 5.

With reference to both FIG. 5 and FIG. 7, FIG. 7 is another timing diagram of the pixel circuit shown in FIG. 5. The timing diagram of FIG. 7 is similar to that of FIG. 6 except that, in the programming stage, the second voltage is the high potential voltage ELVDD and the driving transistor 50 is not reset. The timing diagram shown in FIG. 7 is preferred to be used in the situation that the capacitor Coled of the OLED 51 cannot be ignored (i.e., Coled is not much smaller than the capacitance value Cst of the storage capacitor 56). In the programming stage, the third node 503 is reset to Vdata−Vt. In the moment of turning on the second transistor 58, the voltage $V_N$ of the first terminal 551 of the coupling capacitor 55 is transited as:

$$\begin{aligned} V_N &= \left\{ \begin{matrix} [Vref*(1-f1)+Vdata*f1-Vt]* \\ Cst+[Vdata-Vt]*Coled \end{matrix} \right\} \Big/ (Cst+Coled) \\ &= \left\{ \begin{matrix} [Vref*(1-f1)+Vdata*f1]* \\ Cst+(Vdata*Coled) \end{matrix} \right\} \Big/ (Cst+Coled)-Vt \\ &= Func(Vref, Vdata, Ccp, Cst, Coled)-Vt, \end{aligned} \quad (9)$$

where Func(Vref, Vdata, Ccp, Cst, Coled) is a function of Vref, Vdata, Ccp, Cst and Coled. From equation (9), it can be known that, in the moment of turning on the second transistor 58, the threshold voltage stored by the first terminal 551 of the coupling capacitor 55 is not lost. Under the timing diagram shown in FIG. 7, the second node 502 voltage ($V_G$), the anode 511 voltage ($V_S$) of the OLED 51, the voltage ($V_N$) of the first terminal 551 of the coupling capacitor 55, the voltage difference ($V_{GS}$) between the second node 502 and the anode 511, and the voltage difference ($V_{GN}$) between the second node 502 of the driving transistor 50 and the first terminal 551 of the coupling capacitor 55 are illustrated in Table 3.

TABLE 3

| | Reset stage | Comp. stage | Prog. stage | Emitting stage |
|---|---|---|---|---|
| Second node of the driving transistor ($V_G$) | Vref | Vref | Vdata | Func(Vref, Vdata, Ccp, Cst, Coled) + Vt + Voled |
| Anode of the OLED ($V_S$) | Vrst | Vref − Vt | Vdata − Vt | Voled |
| First terminal of the coupled capacitor ($V_N$) | Vrst | Vref − Vt | Vref * (1 − f1) + Vdata * f1 − Vt | Voled |
| Voltage difference between the second node and the anode ($V_{GS}$) | Vref − Vrst | Vt | Vt | Func(Vref, Vdata, Ccp, Cst, Coled) + Vt |
| Voltage difference between the second node and the first terminal of the coupling capacitor ($V_{GN}$) | Vref − Vrst | Vt | (Vdata − Vref) * (1 − f1) + Vt | Func(Vref, Vdata, Ccp, Cst, Coled) + Vt |

The invention also provides a method for driving a pixel circuit. Also with reference to the pixel circuit shown in FIG. 5, the method includes the steps of: (A) in the reset stage, using the first control signal SN to turn on the first transistor 57, and inputting the reference voltage Vref to the driving transistor 50 for resetting the second node 502, the third node 503 and the first terminal 581 of the second transistor 58; (B) in the compensating stage, storing a threshold voltage Vt of the driving transistor 50 to the third node 503 and the storage capacitor 56, and the driving transistor 50 being transited from on state to off state; (C) in a programming stage, using the second control signal to turn off the second transistor 58, inputting the data voltage Vdata to the driving transistor 50, and coupling a voltage of the coupling capacitor 55 to the first terminal 551 of the coupling capacitor 55; and (D) in the light emitting stage, coupling the threshold voltage Vt and a voltage Voled of the OLED 51 to the second node 502.

Figure 8:
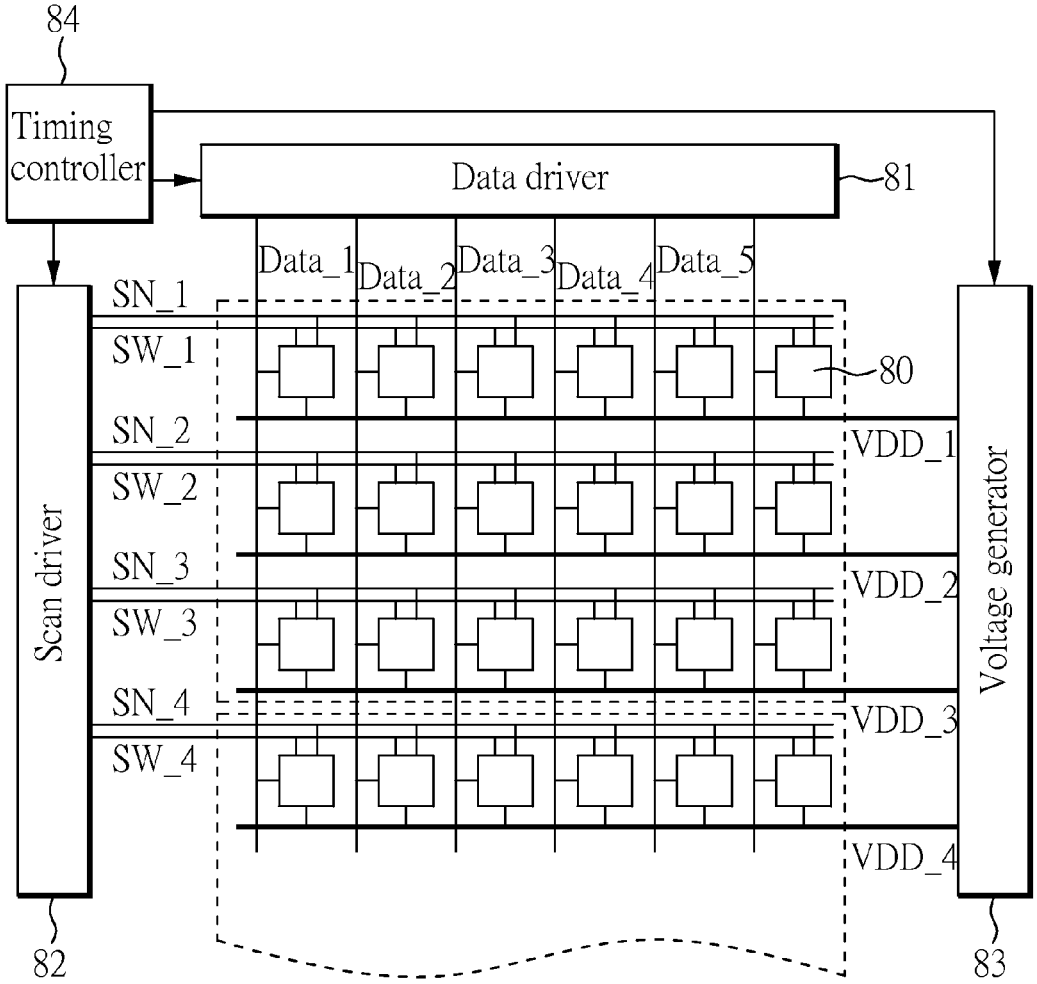
FIG. 8 is a schematic diagram of the display panel in accordance with a preferred embodiment of the invention.

With reference to FIG. 8, there is shown a schematic diagram of the display panel using the aforementioned pixel circuit in accordance with a preferred embodiment of the invention, which includes: a plurality of pixel circuits 80, a data driver 81, a scan driver 82, a voltage generator 83, and a timing controller 84. The pixel circuits 80 are arranged as a pixel circuit matrix according a plurality of columns and rows. The data driver 81 has a plurality of data driving lines (Data_1, Data_2, Data_3, . . . ) connected to the pixel circuits 80 on the columns of the pixel circuit matrix for providing at least an input voltage. The scan driver 82 has a plurality of scan driving lines (SN_1, SW_1, SN_2, SW_2, SN_3, SW_3, . . . ) vertically intersected with the data driving lines for being connected to the pixel circuits 80 on the rows of the pixel circuit matrix for providing at least a switching voltage. The voltage generator 83 has a plurality of voltage supply lines respectively arranged between the scan driving lines for being connected to the pixel circuits 80 so as to supply at least a voltage source. The timing controller 84 is connected to the data driver 81, the scan driver 82, and the voltage generator 83, respectively, for controlling the data driver 81, the scan driver 82, and the voltage generator 83. In one embodiment, the display panel configures three rows of the pixel circuit matrix as a display unit. The reset stage, compensation stage, programming stage and light emitting stage of each display unit are executed sequentially, and the display units are performed sequentially.

Figure 9:
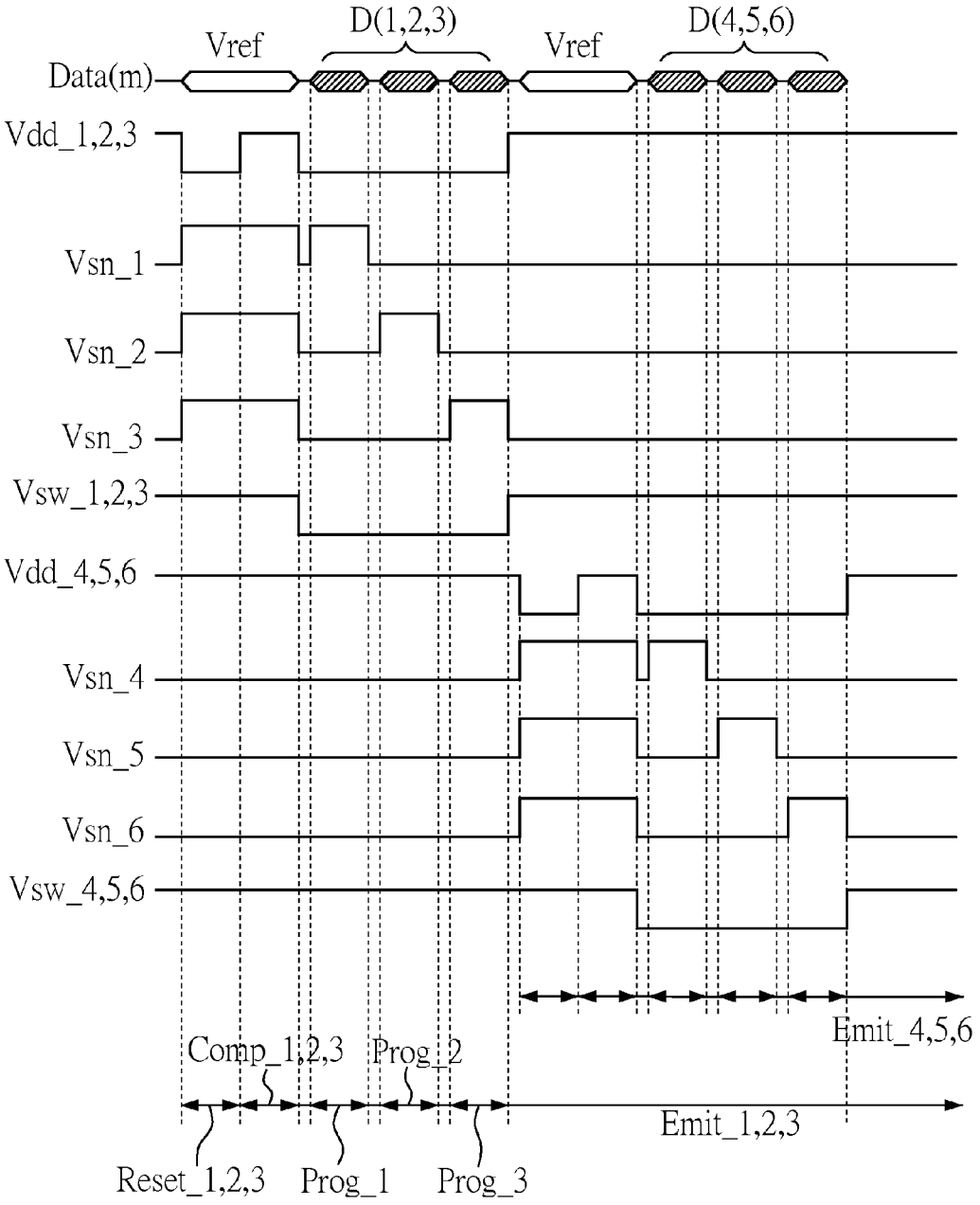
FIG. 9 is a timing diagram for the display panel using three rows of the pixel circuit matrix as a display unit in accordance with the invention.

With reference to FIG. 9, there is shown a timing diagram for the display panel using three rows of the pixel circuit matrix, shown in FIG. 8, as a display unit in accordance with the invention. The embodiment shown in FIG. 9 is similar to that in FIG. 6 except that, in the programming stage, the scan driver 82 sequentially turns on the first transistors 57 of the pixel circuits 80 of each row for the display unit via the scan driving lines (SN_1, SN_2, SN_3) and, at the same time, the data driving line Data(m) inputs a set of data voltage Vdata (1,2,3). The set of data voltage Vdata(1,2,3) sequentially inputs a data voltage to the first transistors 57 of the pixel circuits 80 of each column, corresponding to the scan driving lines (SN_1, SN_2, SN_3) sequentially turning on the first transistors 57 of the pixel circuits 80 of each row. The remaining is operated in the same manner. When the display unit completes the reset stage, the compensation stage, the programming stage and the light emitting stage, the next display unit is then performed sequentially.

Figure 10:
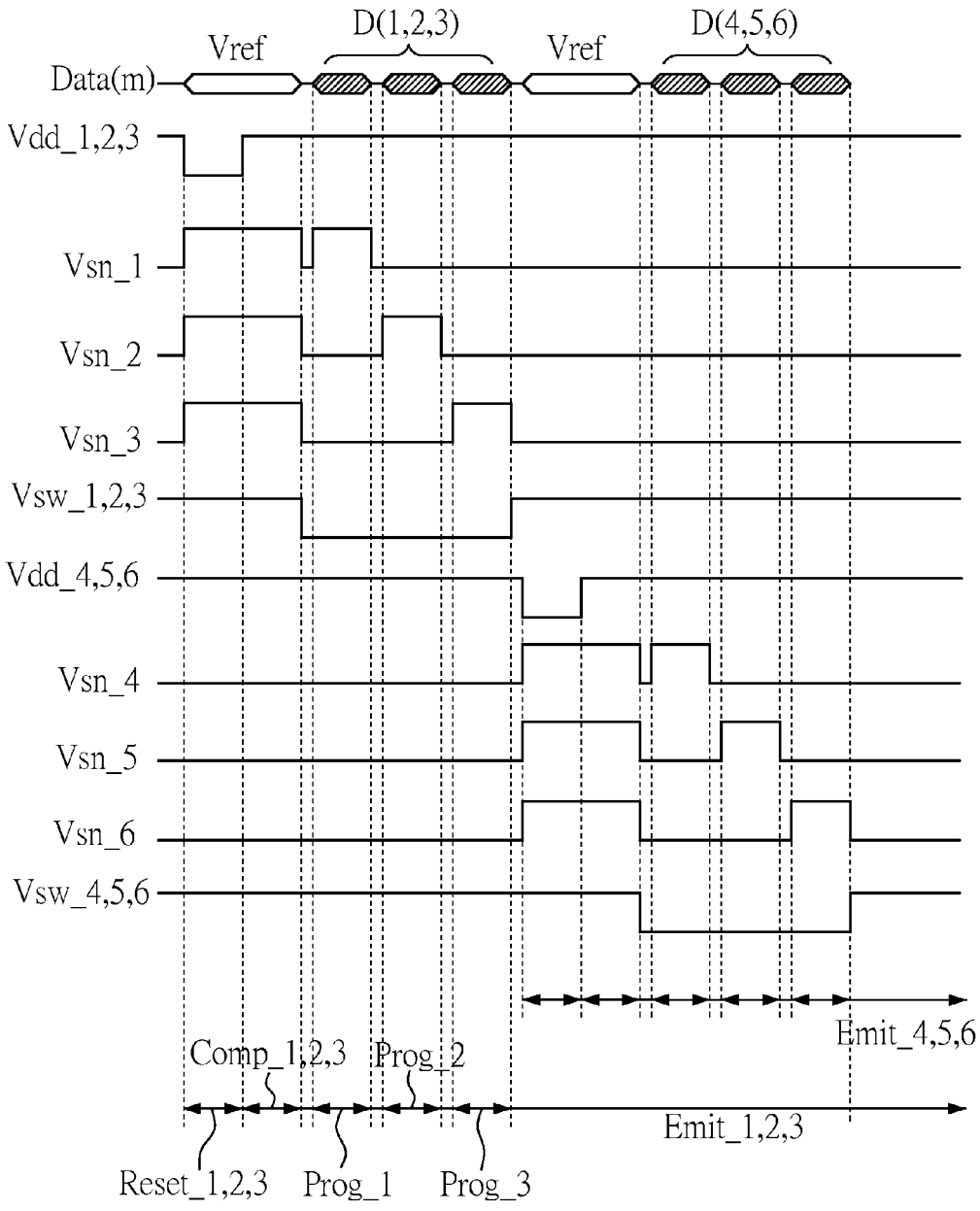
FIG. 10 is another timing diagram for the display panel using three rows of the pixel circuit as a display unit in accordance with the invention.

With reference to both FIG. 8 and FIG. 10, FIG. 10 is another timing diagram for the display panel using three rows of the pixel circuit matrix, shown in FIG. 8, as a display unit in accordance with the invention. As shown in FIG. 10, this embodiment is similar to that in FIG. 7 except that, in programming stage, the scan driver 82 sequentially turns on the first transistors 57 of the pixel circuits 80 of each of three rows for the pixel circuit matrix via the scan driving lines (SN_1, SN_2, SN_3) and, at the same time, the data driving line Data(m) inputs a set of data voltage Vdata(1,2,3). The set of data voltage Vdata(1,2,3) sequentially inputs a data voltage to the first transistors 57 of the pixel circuits 80 of each row corresponding to the scan driving lines (SN_1, SN_2, SN_3) sequentially turning on the first transistors 57 of the pixel circuits 80 of each row. The remaining is operated in the same manner. This embodiment is different from FIG. 9 only in that, in the programming stage, the second voltage Vdd_1,2,3 provided by the voltage supply lines of the voltage generator 83 is maintained at a high voltage ELVDD and the driving transistor 50 is not reset, while the remaining is the same.

Figure 11:
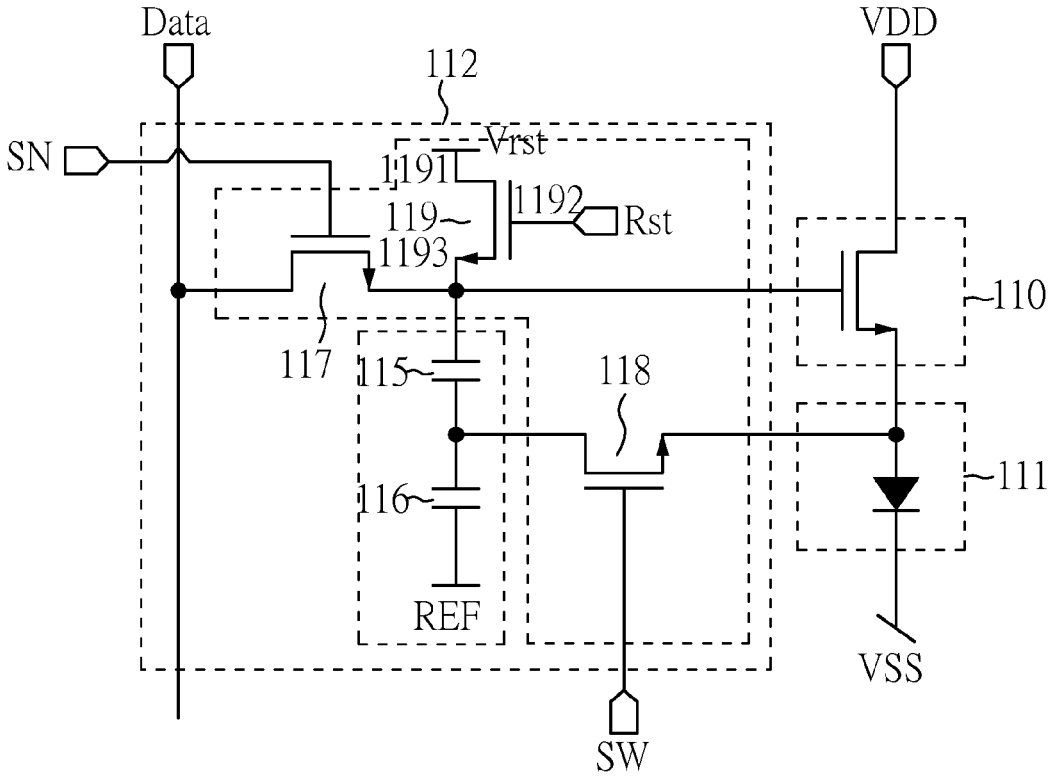
FIG. 11 is a schematic diagram of the pixel circuit in accordance with another preferred embodiment of the invention.
Figure 12:
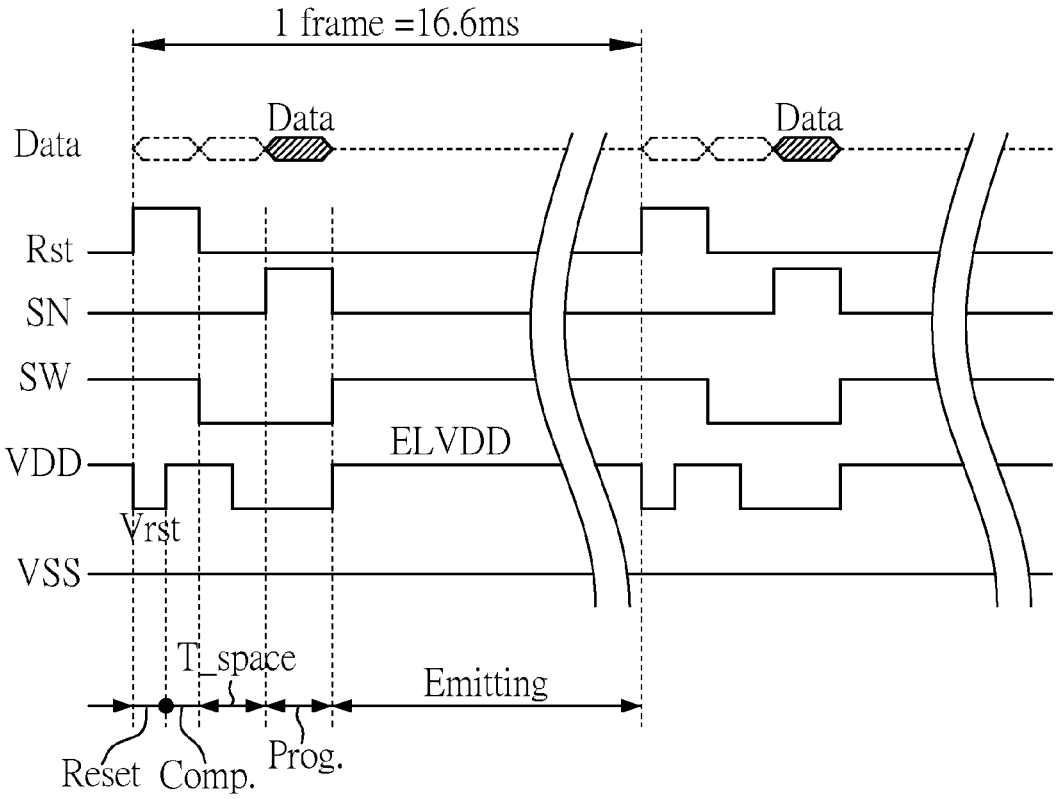
FIG. 12 is a timing diagram of the pixel circuit shown in FIG. 11.

With reference to FIG. 11, there is shown a schematic diagram of the pixel circuit in accordance with another preferred embodiment of the invention. This embodiment is different from FIG. 5 only in that a third transistor 119 is added. The third transistor 119 has a first terminal 1191 connected to a fourth voltage source (Vrst), a second terminal 1192 connected to a third control signal source Rst that provides a third control signal, and a third terminal 1193 connected to the second node 502, wherein the fourth voltage source is used to provide the reference voltage Vref Please also refer to FIG. 12, which is a timing diagram of the pixel circuit shown in FIG. 11. It is proposed to reduce the turn-on frequency of the first control signal in FIG. 6, and to turn on the third transistor 119 by the third control signal so as to input the reference voltage Vref, while the remaining is the same.

Figure 13:
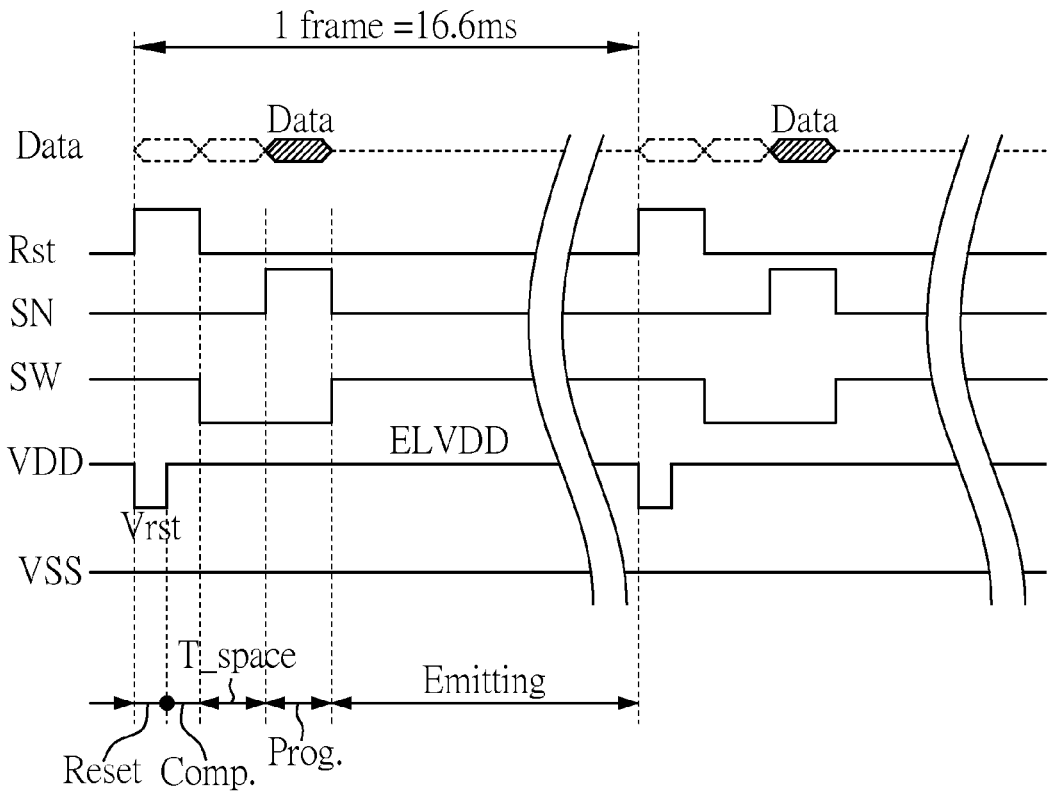
FIG. 13 is another timing diagram of the pixel circuit shown in FIG. 11.

With reference to both FIG. 11 and FIG. 13, FIG. 13 is another timing diagram of the pixel circuit shown in FIG. 11. As shown in FIG. 13, this embodiment is different from FIG. 7 only in that the turn-on frequency of the first control signal Vsn in FIG. 7 is decreased, and the third transistor 119 is turned on by the third control signal so as to input the reference voltage Vref, while the remaining is the same. Further, this embodiment is different from FIG. 12 only in that, in the programming stage, the second voltage Vdd provided by the voltage supply lines of the voltage generator 83 is maintained at a high voltage ELVDD and the driving transistor 50 is not reset, while the remaining is the same.

Figure 14:
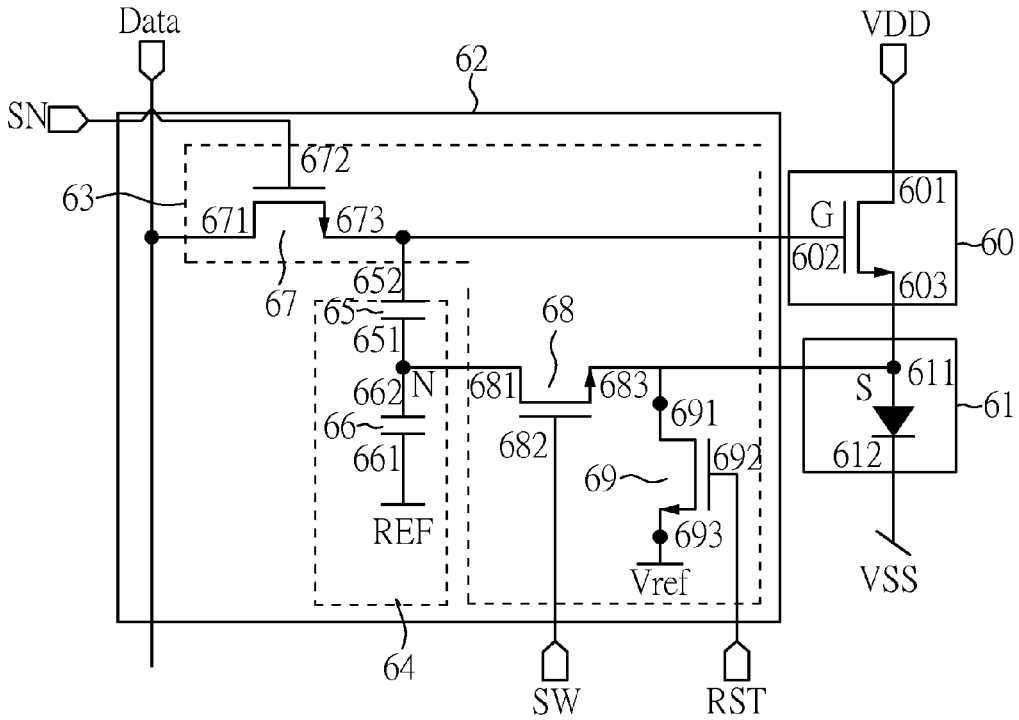
FIG. 14 is a schematic diagram of the pixel circuit in accordance with another preferred embodiment of the invention.

With reference to FIG. 14, there is shown a schematic diagram of a pixel circuit in accordance with another preferred embodiment of the invention. This pixel circuit is implemented for large-scale panel and mesh routing, and efficiently alleviating the problems of signal delay and IR drop. As shown, the pixel circuit includes: a driving transistor 60, an OLED 61, and a voltage control unit 62. The OLED 61 includes an anode 611 and a cathode 612, wherein the cathode 612 is connected to a first voltage source VSS that provides a first voltage Vss. The driving transistor 60 is preferred to be an N-type transistor including a first node 601, a second node 602 and a third node 603, wherein the first node 601 is a drain electrically connected to a second voltage source VDD that provides a second voltage Vdd, the second node 602 is a gate, and the third node 603 is a source electrically connected to the anode 611.

The aforementioned voltage control unit 62 includes a first transistor 67, a second transistor 68, a reset transistor 69, a storage capacitor 66 and a coupling capacitor 65. The first transistor 67 has a first terminal 671 connected to a data driving line (Data), a second terminal 672 connected to a first control signal source SN that provides a first control signal, and a third terminal 673 connected to the second node 602. The second transistor 68 has a first terminal 681, a second terminal 682 connected to a second control signal source SW that provides a second control signal, and a third terminal 683 connected to the anode 611 and the third node 603. The storage capacitor 66 has a first terminal 661 connected to a third voltage source REF that can be replaced by any kind of DC voltage source such as VDD, VSS for compact layout considering, and a second terminal 662 connected to the first terminal 681 of the second transistor 68. The coupling capacitor 65 has a first terminal 651 connected to the first terminal 681 of the second transistor 68, and a second terminal 652 connected to the second node 602. The reset transistor 69 has a first terminal 691 connected to the anode 611 and the third node 603, a second terminal 692 connected to a reset control signal source RST, and a third terminal 693 connected to a reference voltage source (Vref) or the data driving line (Data). The first, second, and reset transistors 67, 68, 69 are preferred to be N-type transistors. Accordingly, when the pixel circuit is in a reset stage, the first control signal source SN provides a first control signal to turn the first transistor 67 on, the second control signal source SW provides a second control signal to turn the second transistor 68 on, the reset control signal source RST provides a reset control signal to turn the reset transistor 69 on, the data driving line (Data) inputs a first reference voltage VR1 to the driving transistor 60 to reset the second node 602, and the reference voltage source provides a second reference voltage Vref or the data driving line (Data) provides the first reference voltage VR1 to the reset transistor 69 to reset the third node 603 and the first terminal 651 of the coupling capacitor 65. When the pixel circuit is in a compensating stage, the data driving line (Data) inputs a third reference voltage VR2 to the second node 602, the third node 603 and the storage capacitor 66 store a voltage difference between the third reference voltage VR2 and the threshold voltage Vt of the driving transistor 60, and the driving transistor 60 is transited from on state to off state. When the pixel circuit is in a programming stage, the data driving line (Data) inputs a data voltage to the driving transistor 60, and a voltage difference between the third reference voltage VR2 and the data voltage is coupled to the first terminal 651 of the coupling capacitor 65. When the pixel circuit is in a light emitting stage, the threshold voltage Vt and a voltage of the OLED 61 are coupled to the second node 602. The aforementioned reset stage, compensation stage, programming stage and light emitting stage are executed repeatedly in sequence.

Figure 15:
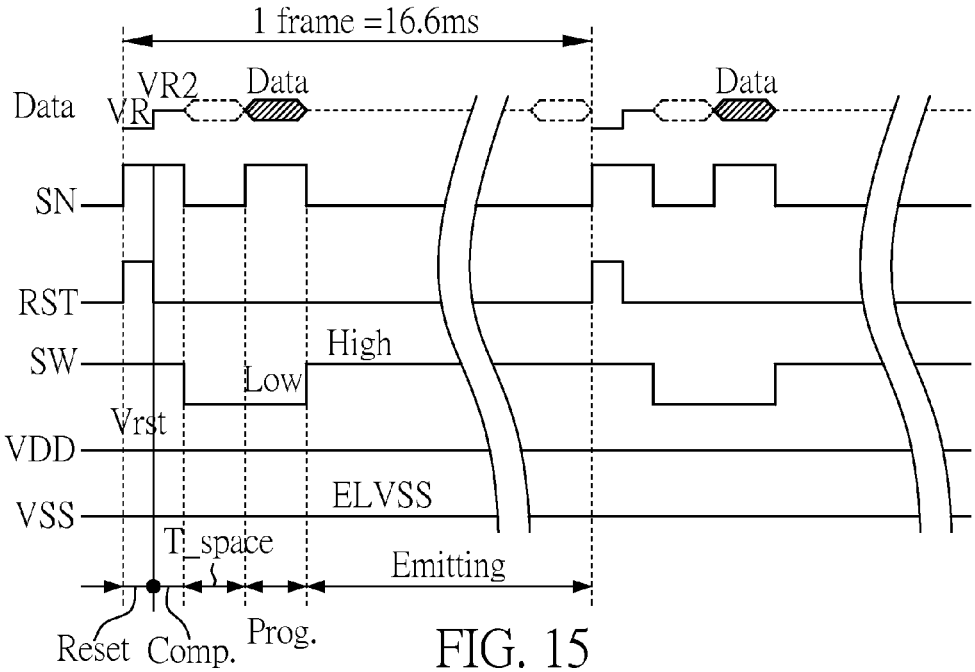
FIG. 15 is a timing diagram of the pixel circuit shown in FIG. 14.

With reference to FIG. 15, which is a timing diagram of the pixel circuit shown in FIG. 14, the circuit operation can be divided into the reset stage (Reset), compensation stage (Comp.), programming stage (Prog.) and light emitting stage (Emitting). The on/off states of the driving transistor 60, the first transistor 67, the second transistor 68, the reset transistor 69 and the OLED 61 corresponding those stages are illustrated in Table 4, and a voltage ($V_G$) of the second node 602 of the driving transistor 60, a voltage (Vs) of the anode 611 of the OLED 61, a voltage ($V_N$) of the first terminal 651 of the coupling capacitor 65, a voltage difference ($V_{GS}$) between the second node 602 and the anode 611, and a voltage difference ($V_{GN}$) between the second node 602 and the first terminal 651 of the coupling capacitor 65 are illustrated in Table 5.

TABLE 4

| Cycle | Driving transistor | First transistor | Second transistor | Reset transistor | OLED |
|---|---|---|---|---|---|
| Reset stage | OFF | ON | ON | ON | OFF |
| Comp. stage | OFF | ON | ON | OFF | OFF |
| Prog. stage | OFF | ON | OFF | OFF | OFF |
| Emitting stage | ON | OFF | ON | OFF | ON |

TABLE 5

| | Reset stage | Comp. stage | Prog. stage | Emitting stage |
|---|---|---|---|---|
| Second node of the driving transistor ($V_G$) | VR1 | VR2 | Vdata | (Vdata − VR2) * (1 − f1) + Vt + Voled |
| Anode of the OLED ($V_S$) | Vref | VR2 − Vt | Vdata − Vt | Voled |
| First terminal of the coupling capacitor ($V_N$) | Vref | VR2 − Vt | VR2 * (1 − f1) + Vdata * f1 − Vt | Voled |
| Voltage difference between the second node and the anode ($V_{GS}$) | VR1 − Vref | Vt | Vt | (Vdata − VR2) * (1 − f1) + Vt |
| Second node and the first terminal of the coupling capacitor ($V_{GN}$) | VR1 − Vref | Vt | (Vdata − VR2) * (1 − f1) + Vt | (Vdata − VR2) * (1 − f1) + Vt |

As a result, in the reset stage, the first transistor 67, second transistor 68, and reset transistor 69 are in on state, and the driving transistor 60 and OLED 61 are in off state. The data driving line (Data) inputs a first reference voltage VR1 to the first terminal 671 of the first transistor 67, and then to the third terminal 673 of the first transistor 67 so as to reset the second node 602 to be the reference voltage VR1, and the reference voltage source inputs a second reference voltage Vref (or the data driving line (Data) inputs the first reference voltage VR1) to the third terminal 693 of the reset transistor 69, and then to the first terminal 691 of the reset transistor 69 so as to reset the third node 603 and the first terminal 651 of the coupling capacitor 65 at the same time, satisfying the relation of VR1 <Vref+Vt, such that there is not any direct current path to be produced in the reset stage.

In the compensation stage, the first transistor 67 and the second transistor 68 are in on state, and the driving transistor 60, reset transistor 69 and OLED 61 are in off state. The data driving line (Data) inputs a third reference voltage VR2 to the first terminal 671 of the first transistor 67, and then to the third terminal 673 of the first transistor 67 so as to reset the second node 602 to be the third reference voltage VR2, such that the driving transistor 60 is turned gradually from on to off by discharging, and the anode 611 of the OLED 61 is discharged to VR2−Vt, so as to measure the threshold voltage Vt of the driving transistor 60. Further, the storage capacitor 66 stores the voltage difference between the third reference voltage VR2 and the threshold voltage Vt of the driving transistor 60.

As shown in FIG. 15, after the compensation stage, there is a space time (T_space), which is a period of time between the compensation stage and the programming stage, and the space time is greater than or equal to 0.

In the programming stage, the first transistor 67 is in on state, and the driving transistor 60, second transistor 68, reset transistor 69, and the OLED 61 are in off state. The data driving line (Data) inputs a data voltage Vdata to the first terminal 671 of the first transistor 67, and then to the third terminal 673 of the first transistor 67 so as to allow the second node 602 to be the data voltage Vdata, such that the voltage $V_N$ of the first terminal 651 of the coupling capacitor 65 is coupled, via the coupling capacitor 65, to:

$$V_N = VR2 - Vt + (Vdata - VR2) * f1 = VR2 * (1 - f1) + Vdata * f1 - Vt, \quad (10)$$

and the voltage difference between the second node 602 and the first terminal 651 of the coupling capacitor 65 is:

$$V_{GN} = Vdata - (VR2(1 - f1) + Vdata * f1 - Vt) = (Vdata - VR2) * (1 - f1) + Vt, \quad (11)$$

wherein f1=Ccp/(Ccp+Cst), Ccp is capacitance value of the coupling capacitor 65, and Cst is capacitance value of the storage capacitor 66. The OLED 61 cannot be turned on, the voltage (Vs) of the anode of the OLED 61 is smaller than a turn-on voltage (Voled) of the OLED 61, the voltage (Vn) of the first terminal of the coupling capacitor 65 is smaller than the voltage (Vs) of the anode of the OLED 61, and thus the following conditions have to be satisfied:

$$\text{Voled}(0) + Vt > V\text{data} > VR2, \quad (12)$$

wherein Voled(0) is a turn-on voltage of the OLED 61.

In the light emitting stage, the driving transistor 60, second transistor 68 and OLED 61 are in on state, and the first transistor 67 and reset transistor 69 are in off state. The anode 611 and the first terminal 651 of the coupling capacitor 65 are both the voltage Voled of the OLED 61, and the coupling capacitor 65 couples the voltage Voled of the OLED 61 to the second node 602:

$$V_G = Vdata + (Voled - (VR2 * (1 - f1) + Vdata * f1 - Vt)) = (Vdata - VR2) * (1 - f1) + Vt + Voled, \quad (13)$$

while the voltage difference between the second node 602 and the anode 611 is:

$$V_{Gs} = (V\text{data} - VR2) * (1 - f1) + Vt, \quad (14)$$

so that the output current $I_{oled}$ of the driving transistor 60 can be expressed as:

$$I_{oled} = Kp*(V_{GS} - Vt)^2 \quad (15)$$
$$= Kp*[(Vdata - Vref)*(1 - f1)]^2,$$

where Kp=½(μ*COX)(W/L), μ is carrier mobility of the driving transistor 60, COX is a per area capacitance of the driving transistor 60, and (W/L) is a width to length ratio of the driving transistor 60. From equation (15), it can be known that the output current of the driving transistor 60 is not related with the threshold voltage Vt and the voltage of the OLED 61 ($V_{oled}$), thereby not only compensating the threshold voltage of the transistor and the voltage of the AMOLED, but also satisfying the requirements of high precision and high aspect ratio.

The invention also provides another method for driving a pixel circuit. Also with reference to the pixel circuit shown in FIG. 14, the method includes the following steps: (A) in a reset stage, the data driving line (Data) inputs a first reference voltage VR1 to the driving transistor 60 to reset the second node 602, and the reference voltage source provides a second reference voltage Vref or the data driving line (Data) provides the first reference voltage VR1 to the reset transistor 69 to reset the third node 603 and the first terminal 651 of the coupling capacitor 65; (B) in a compensating stage, the data driving line (Data) inputs a third reference voltage VR2 to the driving transistor 60 to reset the second node 602, the third node 603 and the storage capacitor 66 store a voltage difference between the third reference voltage VR2 and the threshold voltage Vt of the driving transistor 60, and the driving transistor 60 is transited from on state to off state; (C) in a programming stage, the data driving line (Data) inputs a data voltage Vdata to the driving transistor 60, and a voltage difference between the third reference voltage VR2 and the data voltage is coupled to the first terminal 651 of the coupling capacitor 65; and (D) in a light emitting stage, the threshold voltage Vt and a voltage of the OLED 61 are coupled to the second node 602.

Figure 16:
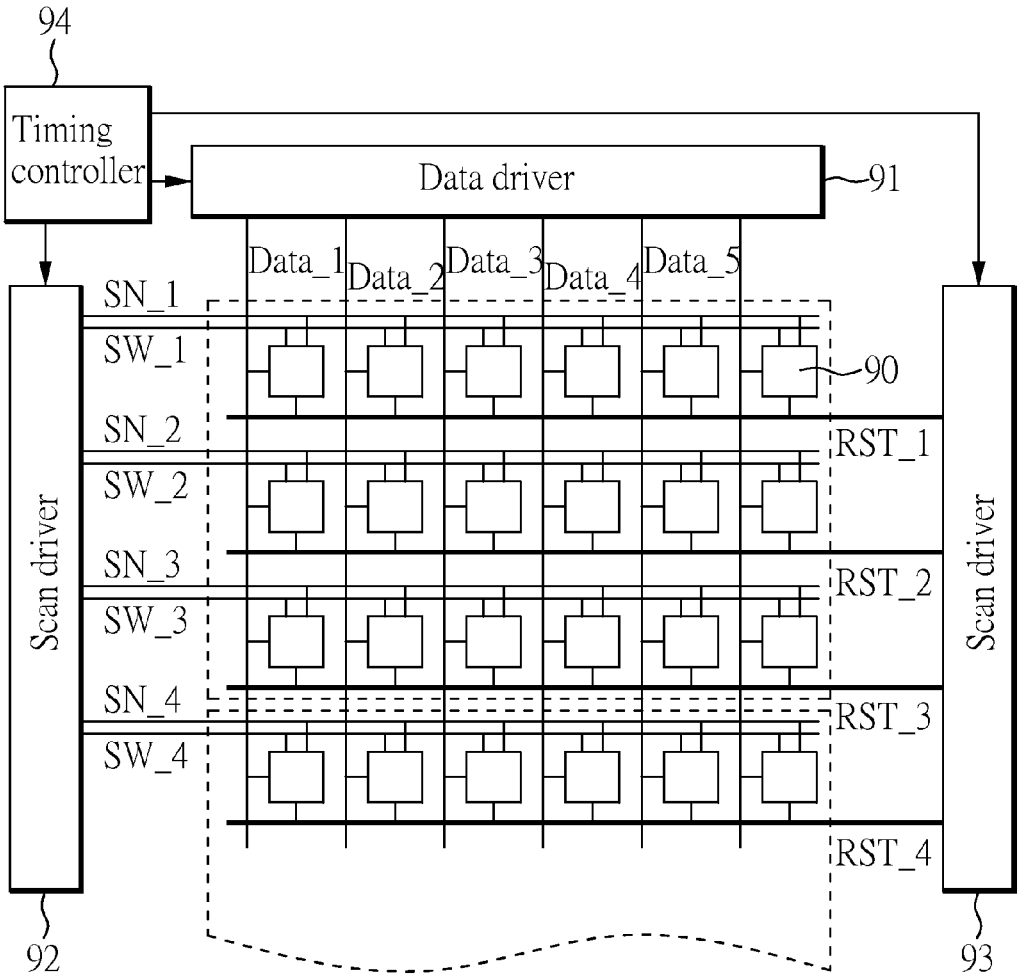
FIG. 16 is a schematic diagram of the display panel in accordance with another preferred embodiment of the invention.
Figure 17:
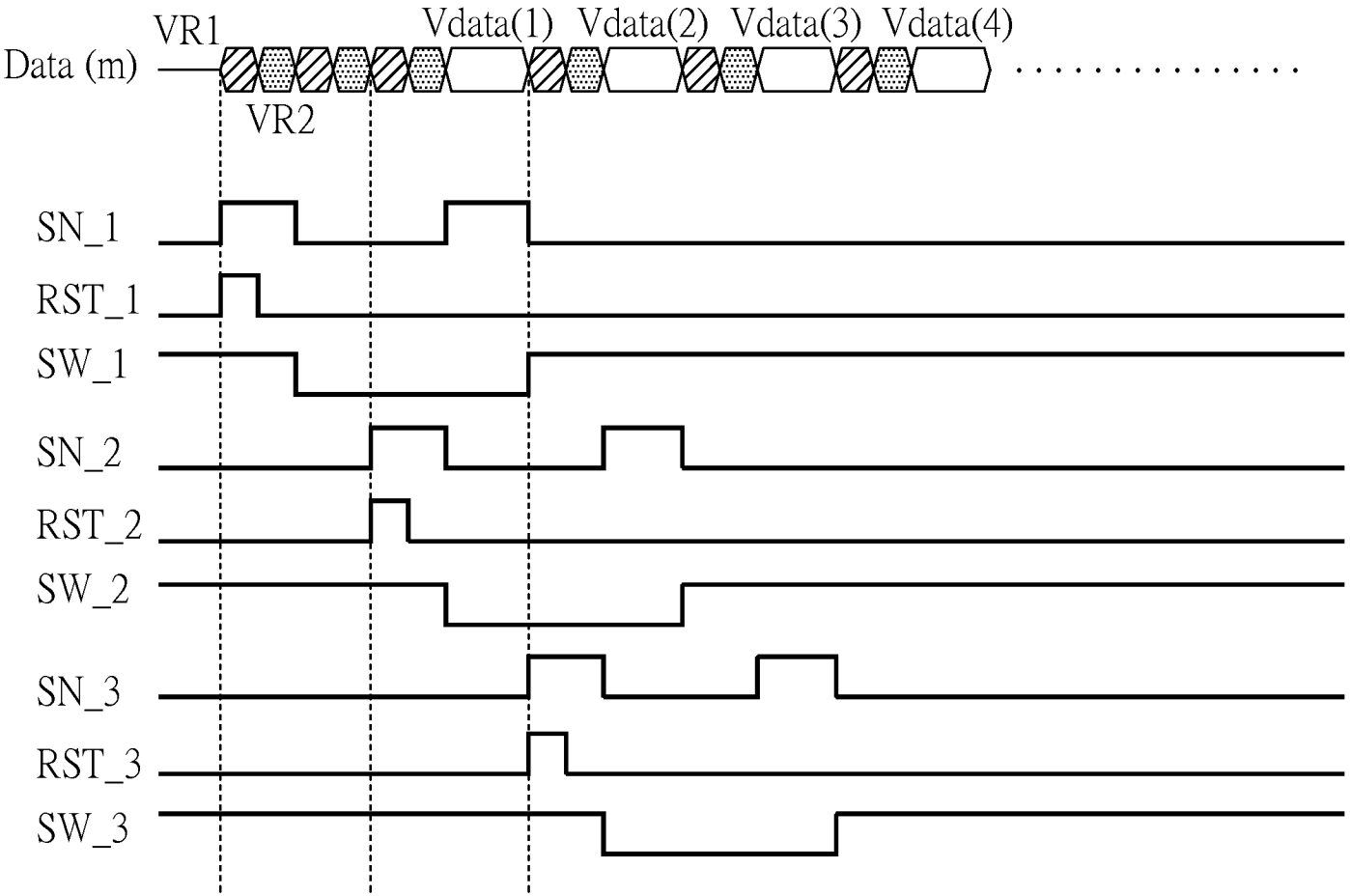
FIG. 17 is a timing diagram for the display panel using one row of the pixel circuit matrix as a display unit shown in FIG. 16.

With reference to FIG. 16, there is shown a schematic diagram of the display panel using the aforementioned pixel circuit in accordance with another preferred embodiment of the invention, which includes: a plurality of pixel circuits 90, a data driver 91, two scan drivers 92, 93, and a timing controller 94. The pixel circuits 90 are arranged as a pixel circuit matrix according a plurality of columns and rows. The data driver 91 has a plurality of data driving lines ($Data_{13}$ 1, Data_2, Data_3, . . . ) connected to the pixel circuits 90 on the columns of the pixel circuit matrix for providing at least an input voltage. The scan driver 92 has a plurality of scan driving lines (SN_1, SW_1, SN_2, SW_2, SN_3, SW_3, . . . ) vertically intersected with the data driving lines for being connected to the pixel circuits 90 on the rows of the pixel circuit matrix for providing at least a switching voltage. The scan driver 93 has a plurality of scan driving lines (RST_1, RST_2, RST_3, . . . ) vertically intersected with the data driving lines for being connected to the pixel circuits 90 on the rows of the pixel circuit matrix for providing at least a switching voltage. The timing controller 94 is connected to the data driver 91 and the two scan drivers 92, 93, respectively, for controlling the data driver 91 and the two scan drivers 92, 93. In one embodiment, the two scan driver 92, 93 can be integrated into one scan driver to have a plurality of scan driving lines (SN_1, SW_1, SN_2, SW_2, SN_3, SW_3, RST_1, RST_2, RST_3, . . . ) for providing at least a switching voltage. With reference to FIG. 17, there is shown a timing diagram for the display panel, as shown in FIG. 16, using one row of the pixel circuit matrix as a display unit in accordance with the invention. The reset stage, compensation stage, programming stage and light emitting stage of each display unit are executed sequentially, and the display units are performed sequentially.

Figure 18:
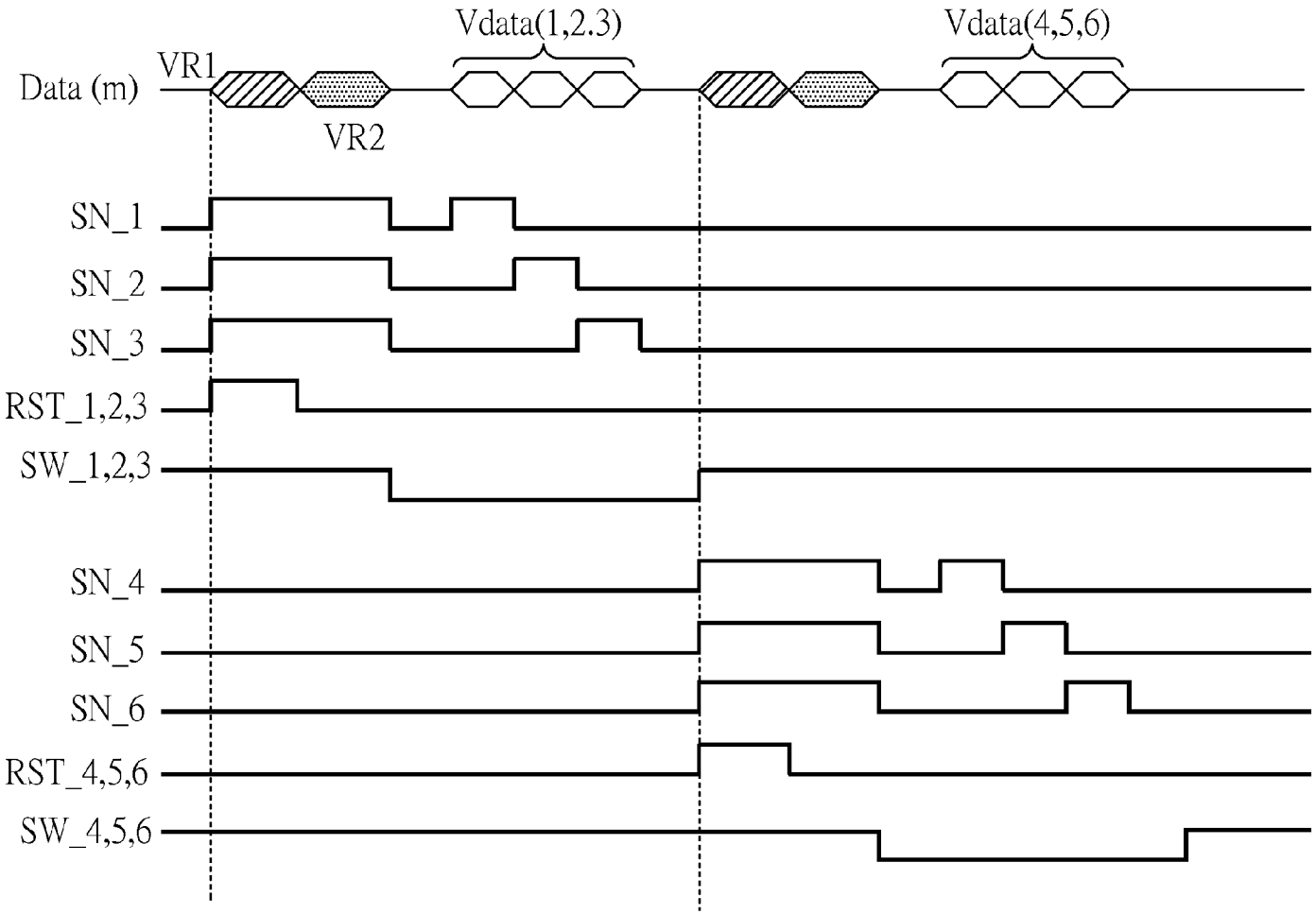
FIG. 18 is a timing diagram for the display panel using three rows of the pixel circuit matrix as a display unit shown in FIG. 16.

With reference to FIG. 18, there is shown a timing diagram for the display panel, as shown in FIG. 16, using three rows of the pixel circuit matrix as a display unit in accordance with the invention. The embodiment shown in FIG. 18 is similar to that in FIG. 15 except that, in the programming stage, the scan driver 92 sequentially turns on the first transistors 97 of the pixel circuits 90 of each row for the display unit via the scan driving lines (SN_1, SN_2, SN_3) and, at the same time, the data driving line Data(m) inputs a set of data voltage Vdata (1,2,3). The set of data voltage Vdata(1,2,3) sequentially inputs a data voltage to the first transistors 67 of the pixel circuits 90 of each column, corresponding to the scan driving lines (SN_1, SN_2, SN_3) sequentially turning on the first transistors 67 of the pixel circuits 90 of each row. The remaining is operated in the same manner. When the display unit completes the reset stage, the compensation stage, the programming stage and the light emitting stage, the next display unit is then performed sequentially.

Figure 19:
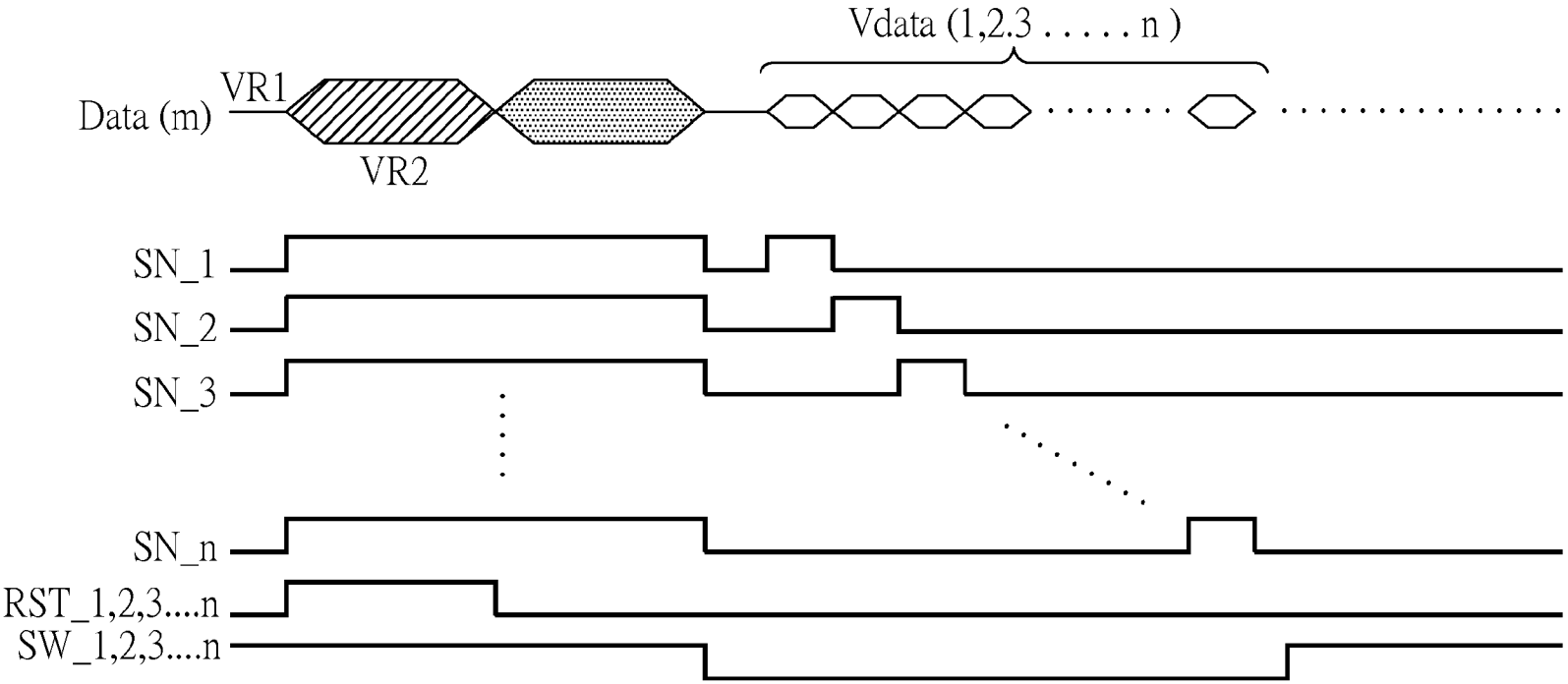
FIG. 19 is a timing diagram for the display panel using n rows of the pixel circuit matrix as a display unit shown in FIG. 16.

With reference to FIG. 19, there is shown a timing diagram for the display panel, as shown in FIG. 16, using n rows of the pixel circuit matrix as a display unit. As shown in FIG. 19, this embodiment is similar to that shown in FIG. 18 except that, the number of rows of the pixel circuit matrix used by the display panel as a display unit is changed from 3 to n. The remaining is operated in the same manner.

Although the present invention has been explained in relation to its preferred embodiment, it is to be understood that many other possible modifications and variations can be made without departing from the spirit and scope of the invention as hereinafter claimed.

What is claimed is:

1. A pixel circuit, comprising:

an OLED including an anode, and a cathode connected to a first voltage source;

a driving transistor for driving the OLED, the driving transistor including a first node connected to a second voltage source, a second node, and a third node connected to the anode;

a first transistor including a first terminal connected to a data driving line, a second terminal connected to a first control signal source, and a third terminal connected to the second node;

a second transistor including a first terminal, a second terminal connected to a second control signal source, and a third terminal connected to the anode and the third node;

a storage capacitor including a first terminal directly connected to a third voltage source and a second terminal directly connected to the first terminal of the second transistor;

a reset transistor including a first terminal directly connected to the anode, a second terminal connected to a reset control signal source, and a third terminal connected to a reference voltage source or the data driving line; and a coupling capacitor including a first terminal directly connected to the first terminal of the second transistor and a second terminal directly connected to the second node;

wherein, in a compensating stage, a voltage of the second voltage source is applied to the driving transistor, and the voltage of the second voltage source is maintained at a same voltage level in a reset, the compensating, and a programming stages.

2. The pixel circuit as claimed in claim 1, wherein the driving transistor, the first transistor, the second transistor and the reset transistor are N-type transistors.

3. The pixel circuit as claimed in claim 1, wherein, in the reset stage, the first control signal source provides a first control signal to turn the first transistor on, the second control signal source provides a second control signal to turn the second transistor on, the reset control signal source provides a reset control signal to turn the reset transistor on, the data driving line inputs a first reference voltage to the driving transistor to reset the second node, and the reference voltage source provides a second reference voltage or the data driving line provides the first reference voltage to the reset transistor to reset the third node and the first terminal of the coupling capacitor; in the compensating stage, the data driving line inputs a third reference voltage to the second node, the third node and the storage capacitor store a difference between the third reference voltage and the threshold voltage of the driving transistor, and the driving transistor is transited from on state to off state; in the programming stage, the data driving line inputs a data voltage to the driving transistor, and a difference between the third reference voltage and the data voltage is coupled to the first terminal of the coupling capacitor; in a light emitting stage, the threshold voltage and a voltage of the OLED are coupled to the second node.

4. A method for driving a pixel circuit, the pixel circuit comprising an OLED including an anode, and a cathode connected to a first voltage source; a driving transistor for driving the OLED, the driving transistor including a first node connected to a second voltage source which provides a second voltage, a second node and a third node connected to the anode; a first transistor including a first terminal connected to a data driving line, a second terminal connected to a first control signal source and a third terminal connected to the second node; a second transistor including a first terminal, a second terminal connected to a second control signal source and a third terminal connected to the anode and the third node; a storage capacitor including a first terminal directly connected to a third voltage source and a second terminal directly connected to the first terminal of the second transistor; a coupling capacitor including a first terminal directly connected to the first terminal of the second transistor and a second terminal directly connected to the second node; and a reset transistor including a first terminal directly connected to the anode, a second terminal connected to a reset control signal source and a third terminal connected to a reference voltage source or the data driving line, the method comprising the steps of:

(A) in a reset stage, the data driving line inputting a first reference voltage to the driving transistor to reset the second node, and the reference voltage source providing a second reference voltage or the data driving line providing the first reference voltage to the reset transistor to reset the third node and the first terminal of the coupling capacitor;

(B) in a compensating stage, the data driving line inputting a third reference voltage to the second node, the third node and the storage capacitor storing a difference between the third reference voltage and the threshold voltage of the driving transistor, and the driving transistor being transited from on state to off state;

(C) in a programming stage, the data driving line inputting a data voltage to the driving transistor, and a difference between the third reference voltage and the data voltage being coupled to the first terminal of the coupling capacitor; and (D) in a light emitting stage, the threshold voltage and a voltage of the OLED being coupled to the second node;

wherein, the voltage of the second voltage source is maintained at a same voltage level in a reset, the compensating, and a programming stages.

5. The method as claimed in claim 4, wherein, in step (A), the first reference voltage is lower than a sum of the second reference voltage and a threshold voltage.

6. The method as claimed in claim 4, wherein, in step (C), the data voltage is lower than a sum of the threshold voltage and an initial voltage of the OLED.

7. The method as claimed in claim 4, wherein the driving transistor, the first transistor, the second transistor and the reset transistor are N-type transistors.

8. A display panel, comprising:

a plurality of pixel circuits arranged as a pixel circuit matrix according a plurality of columns and rows;

a data driver having a plurality of data driving lines connected to the pixel circuits on the columns of the pixel circuit matrix for providing at least an input voltage;

a scan driver having a plurality of scan driving lines vertically intersected with the data driving lines for being connected to the pixel circuits on the rows of the pixel circuit matrix for providing at least a switching voltage; and a timing controller connected to the data driver and the scan driver for controlling the data driver and the scan driver, wherein each of the pixel circuits comprises:

an OLED including an anode, and a cathode connected to a first voltage source;

a driving transistor for driving the OLED, the driving transistor including a first node connected to a second voltage source, a second node, and a third node connected to the anode;

a first transistor including a first terminal connected to a data driving line, a second terminal connected to a first control signal source, and a third terminal connected to the second node;

a second transistor including a first terminal, a second terminal connected to a second control signal source, and a third terminal connected to the anode and the third node;

a storage capacitor including a first terminal directly connected to a third voltage source and a second terminal directly connected to the first terminal of the second transistor;

a reset transistor including a first terminal directly connected to the anode, a second terminal connected to a reset control signal source, and a third terminal connected to a reference voltage source or the data driving line; and a coupling capacitor including a first terminal directly connected to the first terminal of the second transistor and a second terminal directly connected to the second node;

wherein, in a compensating stage, a voltage of the second voltage source is applied to the driving transistor, and the voltage of the second voltage source is maintained at a same voltage level in a reset, the compensating and a programming stages.

* * * * *